US005357716A

United States Patent [19]

Kishida et al.

[11] Patent Number: 5,357,716

[45] Date of Patent: Oct. 25, 1994

[54] HOLDING DEVICE FOR HOLDING OPTICAL ELEMENT TO BE GROUND

[75] Inventors: Takayuki Kishida; Mitsuaki Takahashi, both of Hachiooji; Kazuo Ushiyama, Akishima; Masaki Watanabe, Hachiooji, all of Japan

[73] Assignee: Olympus Optical Company Limited, Japan

[21] Appl. No.: 32,443

[22] Filed: Mar. 15, 1993

Related U.S. Application Data

[63] Continuation of Ser. No. 700,992, May 10, 1991, abandoned, which is a continuation of Ser. No. 600,592, Oct. 17, 1990, abandoned, which is a continuation of Ser. No. 421,261, Oct. 13, 1989, abandoned.

[30] Foreign Application Priority Data

Oct. 20, 1988 [JP] Japan ..... 63-137174[U]
Oct. 27, 1988 [JP] Japan ..... 63-271799
Nov. 11, 1988 [JP] Japan ..... 63-147294[U]

[51] Int. Cl.[5] ..... B24B 41/06

[52] U.S. Cl. ..... 451/390; 451/365; 451/388

[58] Field of Search ..... 51/216 LP, 217 L, 160, 51/162, 240 GB, 284 R, 105 LG, 106 LG, 235

[56] References Cited

U.S. PATENT DOCUMENTS 3,210,894 10/1965 Bentley ..... 51/284
3,693,301 9/1972 Lemaitre ..... 51/284 X
4,313,284 2/1982 Walsh ..... 51/235
4,669,226 6/1987 Mandler ..... 51/217 L

FOREIGN PATENT DOCUMENTS 0169931 2/1986 European Pat. Off. ..... 51/216 LP

*Primary Examiner*—M. Rachuba
*Attorney, Agent, or Firm*—Bruce L. Adams; Van C. Wilks

[57] ABSTRACT

A holding device for holding an optical element to be ground is arranged such that pressure applied to a receiving face of the optical element on the holder base is made different in the radial direction in order to eliminate deformation, positional deviation or inclination of the optical element due to grinding resistances during grinding or due to high-pressure grinding. An elastic member is employed as an elastic member, or a receiving member capable of absorbing the positional deviation, the inclination, or the like of the optical element during grinding thereof is used.

10 Claims, 8 Drawing Sheets

HOLDING DEVICE FOR HOLDING OPTICAL ELEMENT TO BE GROUND

This is a continuation of application Ser. No. 700,992 filed May 10, 1991, now abandoned, which is a continuation of application Ser. No. 600,592 filed Oct. 17, 1990, abandoned, which is a continuation of application Ser. No. 421,261 filed Oct. 13, 1989, now abandoned.

BACKGROUND OF THE INVENTION

1. Field of the Invention

The present invention relates to a holding device for holding an optical element to be ground, such as a lens, a prism or the like.

2. Description of the Related Art

Prior arts which relate to holding devices of this kind are disclosed in Japanese Patent Laid-Open No. 121862/1986 and Japanese Utility Model Publication No. 37627/1987.

In accordance with the art disclosed in Japanese Patent Laid-Open No. 121662/1986, there is provided an apparatus of the type which, as shown in FIG. 21, includes a grinding disc 201 for grinding a lens 203 while rotating in a fluctuating manner and a grinding holder 202 which is held such that its radial plane is perpendicular to the central axis of the grinding disc 201, the lens 203 being ground by the grinding disc 201 as it is pressed against the grinding disc 201 by means of the grinding holder 202. In the construction of the apparatus of this prior art, an elastic member 204 is attached to the end face of the grinding holder 202 which opposes the lens 203, and the grinding holder 202 is fitted onto a holder spindle 205 inserted into a holder shaft 206 so as to elastically apply a pressure to the lens 203 to be ground between the grinding disc 201 and the grinding holder 202. Reference numeral 207 denotes bearings for supporting the holder spindle 205 for rotation about the longitudinal axis thereof, and reference numeral 208 denotes a spindle connected to the grinding disc 201.

The feature of the grinding mechanism having the aforesaid arrangement is that the grinding holder 202 having the elastic member 204 at the end facing the lens 203 is fitted onto the holder spindle 205 inserted into the holder shaft 206.

In accordance with the art disclosed in Japanese Utility Model Laid-Open No. 37627/1987, there is provided a lens holding device for use in an apparatus of the type which, as shown in FIG. 22, includes a grinding disc 210 arranged to rotate about the longitudinal axis of the apparatus as indicated by the arrow shown in a lower portion of the figure and a lens moving rod 211 arranged to travel in the horizontal direction while pressing the surface of the grinding disc 210 with its longitudinal axis always kept normal to the surface of the grinding disc 210. This lens holding device comprises an inverted-cup-shaped member 212 secured to one end of the lens moving rod 211 for rotation about the axis thereof, a lens holder 214 removably fitted into the inverted-cup-shaped member 212 and engaged with the edge of the open end of the inverted-cup-shaped member 212 via an elastic member 213, the lens holder 214 being capable of tilting by slight angles with respect to the inverted-cup-shaped member 212, a recess means 216 formed in the lower end portion of the lens holder 214 which is radially inward of the edge of the open end of the inverted-cup-shaped member 212, the recess means 216 serving to securely receive a lens 215 while reducing a moment resulting from the horizontal travel and acting to rotate the lens 215, a bore 217 formed in the lens holder 214 to place the recess means 216 in communication with a space defined in the inverted-cup-shaped member 212, and a communication bore 218 for providing communication between the space defined in the inverted-cup-shaped member 212 and an evacuating pump (not shown) to attract the lens holder 214, hence the lens 216, into the inverted-cup-shaped member 212 by vacuum.

The lens holding device having the aforesaid construction and arrangement is capable of grinding a lens of small diameter and large thickness with high precision and helps to facilitate lense replacement and the alteration of a lens size.

The above-described prior arts, however, have not been satisfactory proposals in that they involve the following problems. The apparatus which relies on the art disclosed in Japanese Patent Laid-Open No. 121862/1986 has no mechanism for restricting radial movement of the lens 203. As a result, while grinding is being performed using a fixed abrasive grinding stone or the like, the lens 203 is pulled in the radial direction by grinding resistances, so that the axis of the lens 203 may deviate to a serious extent.

In contrast, in accordance with the art disclosed in Japanese Utility Model Publication No. 37627/1987, the radial movement of the lens 215 is restricted by the lens holder 214. However, since this lens holder 214 is attracted by vacuum into the inverted-cup-shaped member 212 via the elastic ring 213, the entire lens holder 214 is pulled in the radial direction due to grinding resistances produced during grinding, as in the art disclosed in Japanese Patent Laid-Open No. 121862/1986. This leads to the problems that the axis of the lens 215 deviates and that the elastic ring 213 is excessively compressed over its entire circumference to hinder satisfactory relaxation of elastic forces.

Because of the above-described problems, either of the aforesaid prior arts involves the serious problem that the lens may vibrate during grinding so vehemently as to disable continuation of the grinding or to deteriorate the precision of a ground surface to produce a number of imperfect products.

Conventionally, lenses of the type which can be independently ground have in most cases been subjected to nonblocking grinding (the process of grinding an object while retaining it in a holding device without the use of any adhesive). A typical example of this holder is shown in FIG. 20. In the figure, a holder 142 which constitutes the body of a holding device 141 is provided with a recess having a receiving face 143 which is covered with a receiving member 144 made of elastic material such as rubber or the like, and a lens 145 as an object to be ground is fitted into the recess with the receiving member 144 sandwiched between the lens 145 and the receiving face 143. With the aforesaid construction and arrangement, it is possible to effect nonblocking grinding without impairing the external appearance or the quality of the receiving face 146 of the lens 145 of relatively thick configuration.

In such a conventional holding device for use in a grinding apparatus, however, the overall portion of the receiving member 144 having elasticity is sandwiched and restricted in position between the holder 142 and the lens 145 owing to pressures applied to the lens 145 during grinding thereof. As a result, satisfactory relaxation of elastic force (or uniform deformation of the elastic member) is not achieved. Distorted Newton fringes, which may be produced by the influence of a variation in the strength of grinding pressure, such as an excessive increase in peripheral pressure or central pressure, are not formed in lenses of relatively thick configuration. However, if a lens to be ground has a particular configuration, for example a relatively thin configuration, variations in the strength of the grinding pressure are caused by nonuniform elastic forces. As a result, the lens is deformed and unwanted Newton fringes are formed, so that a high-precision ground surface is not obtained.

SUMMARY OF THE INVENTION

It is, therefore, an object of the present invention to provide a holding device for holding an optical element to be ground, which device is capable of holding the optical element while preventing the deformation thereof even during high-pressure grinding without the risk of impairing the external appearance or the quality of the receiving face of the optical element to be ground.

It is another object of the present invention to provide a holding device for holding an optical element to be ground, which device makes it possible to prevent a lens from vibrating vehemently during grinding thereof, thereby enabling production of a high-quality lens of improved surface precision.

To achieve the above objects, in accordance with the present invention, there is provided a holding device for holding an optical element to be ground, which device is arranged such that pressure applied to a receiving face of the optical element on a holder base is made different in the radial direction in order to eliminate deformation, positional deviation or inclination of the optical element due to grinding resistances during grinding or due to high-pressure grinding. An elastic member is employed for a receiving member or a receiving member capable of absorbing the positional deviation, the inclination or the like of the optical element during grinding thereof is used.

The above and other objects, features and advantages of the present invention will become apparent from the following description of the preferred embodiments thereof, taken in conjunction with the accompanying drawings.

BRIEF DESCRIPTION OF THE DRAWINGS:

FIG. 8 is a partially broken away schematic side elevational view which serves to illustrate the concept of seventh to tenth embodiments;

DESCRIPTION OF THE PREFERRED EMBODIMENTS

Embodiments of the present invention will be described in detail below with reference to the accompanying drawings.

Figure 1:
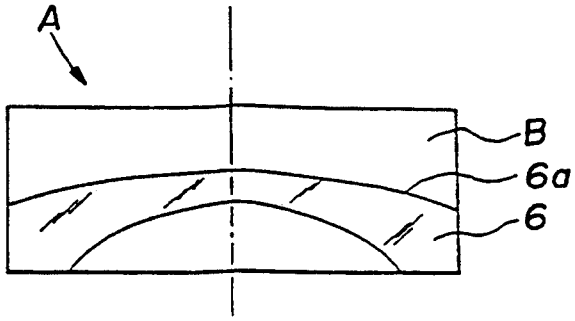
FIG. 1 is a schematic cross-sectional side elevational view which serves to illustrate the concept of the holder base used in a holding device for holding an optical element to be ground in accordance with the present invention.

FIG. 1 is a diagrammatic cross-sectional view of a holder base and serves to illustrate the concept of the present invention.

In a grinding holding device denoted by A, a lens receiving face 6*a* of a lens 6 to be ground is retained by a holding member B. During grinding of the lens 6, the lens receiving face 6a of the lens 6 is subjected to uniform pressure owing to the holding member B. Accordingly, the elasticity of the holding member B is varied in the radial direction of the lens 6.

Individual embodiments of the present invention based on the above-described concept will be explained below.

FIRST EMBODIMENT

Figure 2:
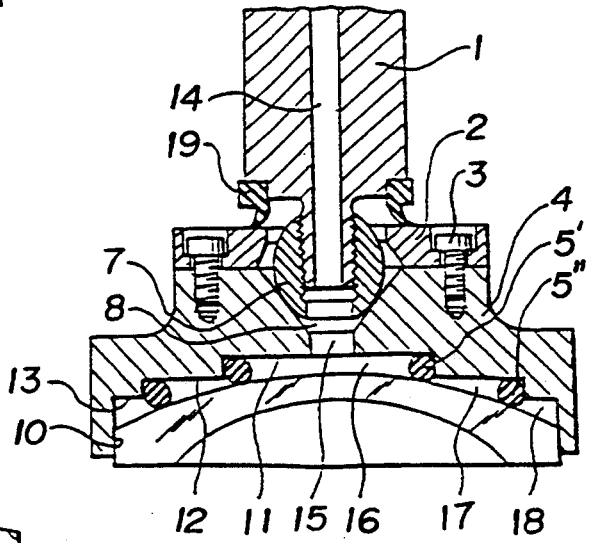
FIG. 2 is a diagrammatic side elevational view which shows in section a first embodiment of the holding device for holding an optical element to be ground in accordance with the present invention.

FIG. 2 is a side elevational view showing in section a holder base according to a first embodiment of the present invention.

In FIG. 2, a holder base 4 has an upper end face which is circular in plan view and flat in side view. A cone-shaped recess 8 is formed in the upper portion of the holder base 4 at the center thereof. The cone-shaped recess 8 is connected with a driving device (not shown) in an upright form and is engaged with a spherical end portion 7 of a rod-like coupling member 1. A recess 10 is defined in the lower end portion of this holder base 4, and three steps 11, 12 and 13 are formed in the recess 10 concentrically from the center to the periphery thereof in such a manner that all the steps have the same height along the longitudinal axis of the apparatus.

Elastic members 5' and 5" are fitted into the circumferential walls of the steps 11 and 12, respectively. Each of the elastic members 5' and 5" has a ring-like configuration with a thickness which is slightly greater than the height of the circumferential wall of the corresponding step. The ring-shaped elastic members 5' and 5" are made of, for example, rubber or synthetic resin.

The surface of a lens 6 to be ground is held in precise contact with the lower surface portions of the respective elastic members 5' and 5" and the inner periphery of the holder base 4 which defines the recess 10.

A fluid port 15 is formed in the center of the holder base 4 so that a fluid can flow through it. A ventilation bore 14, which is connected to a fluid supplying means (not shown) for feeding a fluid such as air, extends through the spherical end portion 7 engaged with the holder base 4 and the coupling member 1 along the longitudinal axis of the apparatus.

In the aforesaid arrangement and construction, the lens 6 to be ground is retained by means of both the elastic members 5' and 5" and the lower end portion of the holder base 4 which defines the recess 10, and an air gap 16 (as a pressure chamber) is formed between the step 11 and the lens 6, an air gap 17 (as a pressure chamber) between the step 12 and the lens 6, and an air gap 18 between the step 13 and the lens 6.

A securing disc 2 of a planar configuration is mounted on the upper end face of the holder base 4 at a location where it does not hinder the rotation of the aforesaid end portion 7 of the coupling member 1. This securing disc 2 serves to prevent the end portion 7 from coming off the cone-shaped recess 8 in the upper end portion of the holder base 4. A dust cover 19 is provided to cover the space between the securing disc 2 and the opposing face of the coupling member 1.

The operation of the first embodiment having the above-described construction is explained below.

The holder base 4 is positioned on a lower disc-shaped support (not shown) and the driving device (not shown) is then actuated to cause the holder base 4 to rotate about its axis.

At the same time that the holder base 4 starts to rotate, the fluid supplying means (not shown) connected to the ventilation bore 14 is actuated. The fluid supplied by the fluid supplying means is charged through the fluid port 15 of the holder base 4 into the air gap (pressure chamber) 16 defined between the holder base 4 and the lens 6 to be ground. The charged fluid applies a pressure to a surface (lens-side receiving face) 6a of the lens 6 to be ground. In this manner, the fluid pressure is applied to the portion of the lens-side receiving face 6a which is centered around the optical axis (the Z axis shown in the figure) and which is easily deformed, in such a manner that the deformation of the lens 6 can be minimized. Accordingly, the lens 6 is ground with a high-precision lens without any deformation.

In accordance with the first embodiment having the above-described arrangement and operation, the limited portion of the lens 6 which is centered around the optical axis is pressed so that the lens 6 is ground under averaged pressure without any deformation. Accordingly, it is possible to produce an optical element of high quality and high precision.

SECOND EMBODIMENT

Figure 3:
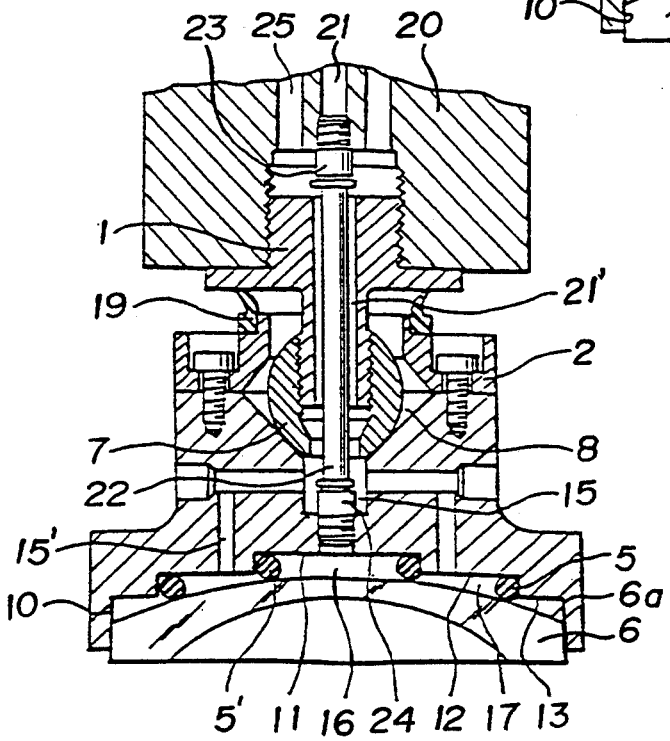
FIG. 3 is a diagrammatic side elevational view which shows in section a second embodiment of the holding device for holding an optical element to be ground in accordance with the present invention.

FIG. 3 is a side elevational view showing in section a holder base according to a second embodiment of the present invention. In this figure, the same reference numerals are used to denote the same constituent elements as those used in the first embodiment, and the explanation thereof is therefore omitted.

In FIG. 3, a holder base 4 has an upper end face which is circular in plan view and flat in side view. A cone-shaped recess 8 is formed in the upper portion of the holder base 4 at the center thereof. The cone-shaped recess 8 is connected with a driving means (not shown) in an upright form and is engaged with a spherical end portion of the coupling member 1. A recess 10 is defined in the lower end portion of this holder base 4, and three steps 11, 12 and 13 are formed in the recess 10 concentrically from the center axis to the periphery thereof in such a manner that all the steps have the same height along the longitudinal axis of the apparatus.

Elastic members 5' and 5" are fitted into the circumferential walls of the steps 11 and 12, respectively. Each of the elastic members 5' and 5" has a ring-like configuration with a thickness which is slightly greater than the height of the wall of the corresponding step.

The surface of a lens 6 to be ground is held in precise contact with the lower surface portions of the respective elastic members 5' and 5" and the inner periphery of the holder base 4 which defines the recess 10.

An air gap (as a pressure chamber) 16 is hermetically formed between the elastic member 5' and the lens 6, and an air gap (as a pressure chamber) 17 between the elastic member 5" and the lens 6. A securing disc 2 is mounted on the upper end surface of the holder base 4 at a location above the end portion 7 of the coupling member 1. The proximal end of the coupling member 1, that is, the upper portion of the coupling member 1 as viewed in FIG. 3, is connected to a columnar upper shaft 20, which is in turn connected to a driving source (not shown).

A ventilation bore 21 extends through the upper shaft 20 along the center axis thereof, a fluid passage 21' extends through the coupling member 1 along the center axis thereof, and a ventilation port 15 is formed in the holder base 4 at the center thereof. The ventilation bore 21 and the holder base 4 are connected by a flexible tube 22 which extends through the fluid passage 21' and the ventilation port 15. More specifically, the upper end of the flexible tube 22 is connected to a joint 23 mounted on one end of the fluid passage 21 of the upper shaft 20, while the lower end of the flexible tube 22 is connected to the holder base 4 via a rotary joint 24 which rotates about the Z axis of the holder base 4 so as to enable evacuation while lens grinding is being performed.

The aforesaid fluid passage 21 communicates with the pressure chamber 16 defined on the lower end face of the holder base 4 at the central portion thereof.

A fluid passage 25 extends through the upper shaft 20 along the longitudinal axis thereof, and communicates with the air gap around the outer periphery of the flexible tube 22. This air gap communicates, through fluid bores 15' formed in the holder base 4, with the pressure chamber 17 which is defined around the pressure chamber 16 on the lower end surface of the holder base 4.

In the second embodiment having the above-described construction, different kinds of fluids can be fed into the pressure chambers 16 and 17 which are formed in the holder base 4. More specifically, a first channel means is formed by the fluid passage 21 of the upper shaft 20, the flexible tube 22 disposed in the coupling member 1 along the central axis thereof, and the rotary joint 24 provided on the holder base 4, the first channel means communicating with the pressure chamber 16. A second channel means is formed by the fluid passage 25 which is defined around the fluid passage 21 in the upper shaft 20, a fluid passage 21' defined around the flexible tube 22 in the coupling member 1, a fluid port 15 formed in the holder base 4, and a plurality of fluid bores 15' which branch from the fluid port 15 at the position of the rotary joint 24, the second channel means communicating with the pressure chamber 17 defined on the upper end face of the holder base 4. Accordingly, different magnitudes of fluid pressures can be supplied to the respective pressure chambers 16 and 17 through the corresponding channel means.

With the aforesaid arrangement and construction, since different magnitudes of fluid pressures can be applied to individual pressure chambers, the deformation of a lens during grinding can be prevented with far higher precision, whereby an even higher grinding precision can be achieved.

THIRD EMBODIMENT

Figure 4:
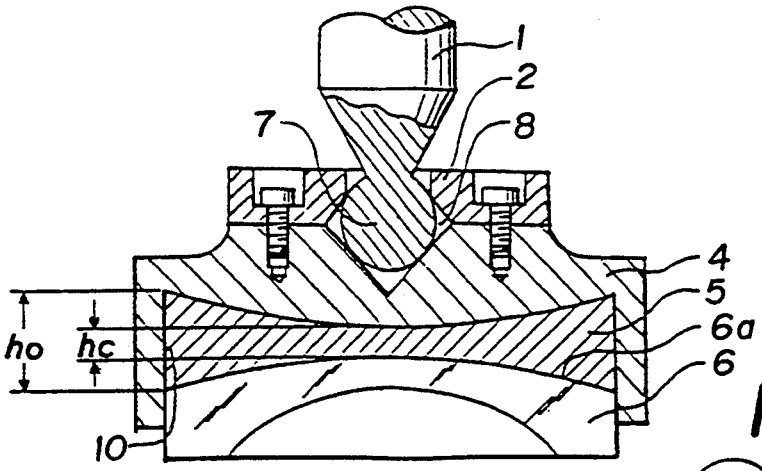
FIG. 4 is a diagrammatic side elevational view which shows in section a third embodiment of the holding device for holding an optical element to be ground in accordance with the present invention.

FIG. 4 is a side elevational view showing in section a holder base according to a third embodiment of the present invent ion.

In this figure, the same reference numerals are used to denote the same elements as those used in the first or second embodiment, and the explanation of the corresponding elements is not given. As illustrated, a holder base 4 has a cone-shaped recess 8 formed in its upper portion, and the cone-shaped recess 8 is engaged with a spherical end portion 7 of a coupling member 1. A securing disc 2 is mounted on the upper end face of the holder base 4 so as to allow the end portion 7 to freely rotate and to prevent it from coming off the cone-shaped recess 8.

A recess 10 is formed in the lower end portion of the holder base 4 so as to accommodate an elastic member the thickness of which is varied in the radial direction of the lens 6 to be ground. The lower end face of the elastic member 5 is maintained in close contact with the lens 6 so as to define the lens-side receiving face **6*a* of the lens 6. In other words, the holder base 4 retains the lens 6 through the elastic member 5**.

As a matter of course, if the lens 6 to be ground is a different type of lens such as a lens with convex opposite surfaces, a lens with concave opposite surfaces, or the like, the radial distribution of the thickness of the elastic member 5 is varied in accordance with the configuration of each type of lens. In brief, in accordance with the third embodiment, the thickness hc of the portion of the elastic member 5 which is exposed to a high grinding pressure is made small, whereas the thickness h0 of the portion which is exposed to a low grinding pressure is made large.

In accordance with the third embodiment having the above-described arrangement and construction, the displacement of the elastic member 5 caused by a grinding pressure along the Z axis (central axis) can be uniformly dispersed from the central axis to the periphery of the lens 6 to be ground. Accordingly, the deformation of the lens 6 during grinding can be lessened to a sufficient extent so that grinding accuracy can be further improved.

FOURTH EMBODIMENT

Figure 5:
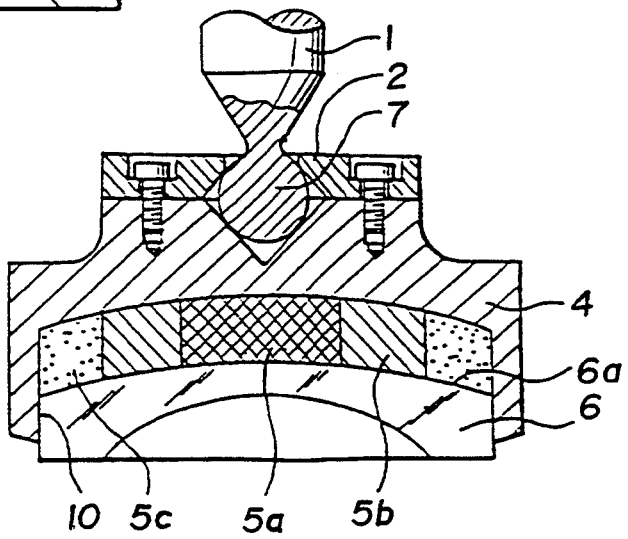
FIG. 5 is a diagrammatic side elevational view which shows in section a fourth embodiment of the holding device for holding an optical element to be ground in accordance with the present invention.

FIG. 5 is a side elevational view showing in section a holder base according to a fourth embodiment of the present invention.

In this figure, the same reference numerals are used to denote the same elements as those used in any one of the embodiments described above, and the explanation of the corresponding elements is not given. As illustrated, a holder base 4 has a cone-shaped recess 8 formed in its upper portion, and the cone-shaped recess 8 is engaged with a spherical end portion 7 of a coupling member 1. A securing disc 2 is mounted on the upper end face of the holder base 4 so as to allow the end portion 7 to freely rotate and to prevent it from coming off the cone-shaped recess 8. A disc-shaped opening 10, which has a configuration corresponding to that of a lens 6 to be ground, is formed in the lower end portion of the holder base 4.

An elastic member 5, which partially differs in elasticity such as hardness, modulus of elasticity and the like and which is shaped into a configuration corresponding to the surface configuration of the lens 6, is fitted into the disc-shaped opening 10. More specifically, the elastic member 5 consists of at least two different kinds of elastic elements which are arranged concentrically from the central axis. In the elastic member 5 shown in FIG. 5 by way of example, since the illustrated lens 6 to be ground is a meniscus lens of the kind which suffers the most serious deformation due to grinding pressure, elastic elements **5*a*, 5*b* and 5*c* are combined so that the elasticity decreases from the center to the periphery of the lens 6** in three steps.

As a matter of course, if the lens 6 to be ground is a different type of lens such as a lens with convex opposite surfaces, a lens with concave opposite surfaces, or the like, the radial combination of the elastic element in the elastic member 5 is varied in accordance with the configuration of each type of lens. In brief, in accordance with the fourth embodiment, the elasticity of the elastic element of the elastic member 5 which is exposed to a high grinding pressure is made small, whereas the elasticity of the elastic element which is exposed to a low grinding pressure is made large.

In accordance with the fourth embodiment having the above-described arrangement and construction, the displacement of each elastic element **5*a*, 5*b* and 5*c* along the Z axis, caused by a grinding pressure to be transmitted to the lens 6 to be ground, can be made uniform from the central axis to the periphery of the lens 6**.

Accordingly, the deformation of the lens 6 during grinding can be lessened to a sufficient extent so that grinding accuracy can be further improved.

FIFTH EMBODIMENT

Figure 6:
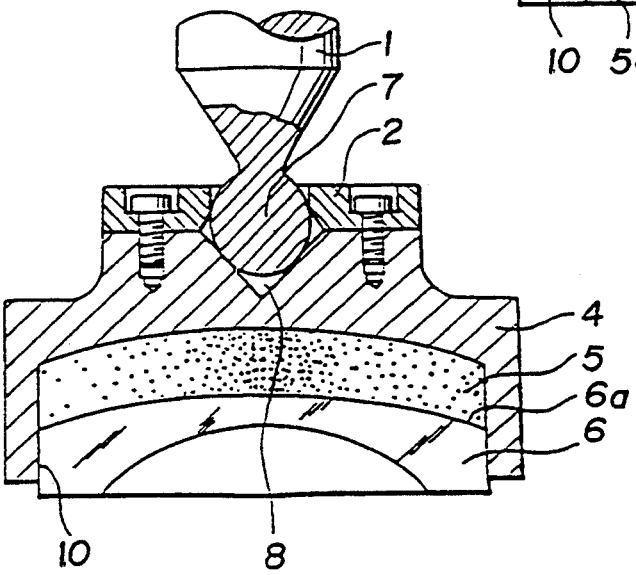

FIG. 6 is a side elevational view showing in section a holder base according to a fifth embodiment of the present invention. In this figure, the same reference numerals are used to denote the same elements as those used in any of the embodiments described above, and the explanation of the corresponding elements is not given.

As illustrated, a holder base 4 has a cone-shaped recess 8 formed in its upper portion, and the cone-shaped recess 8 is engaged with a spherical end portion 7 of a coupling member 1. A securing disc 2 is mounted on the upper end face of the holder base 4 so as to allow the end portion 7 to freely rotate and to prevent it from coming off the cone-shaped recess 8.

A disc-shaped opening 10, which has a configuration corresponding to that of a lens 6 to be ground, is formed in the lower end portion of the holder base 4.

An elastic member 5, which is fitted into the disc-shaped opening 10, contains bubbles which are varied, for example in number or density, in order to distribute the elasticity of the elastic member 5 in the radial direction of the lens 6 so that the deformation of the lens 6 to be ground is prevented. More specifically, the elastic member 5 includes bubbles which are varied in number or the like in the radial direction, and a lens-side receiving face 6*a* defined by the lower end face of the elastic member 5 is maintained in close contact with the lens 6 to be ground.

In the elastic member 5 shown in FIG. 6 by way of example, since the illustrated lens 6 to be ground is a meniscus lens of the kind which suffers the most serious deformation due to grinding pressure, an elastic member of the kind whose elasticity gradually decreases from the center to the outer periphery which exhibits the smallest deformation may be employed.

As a matter of course, if the lens 6 to be ground is a different type of lens such as a lens with convex opposite surfaces, a lens with concave opposite surfaces, or the like, the radial distribution of the elasticity of the elastic member 5 is varied in accordance with the configuration of each type of lens.

In accordance with the fifth embodiment having the above-described arrangement and construction, the displacement of the elastic element 5 along the Z axis (central axis), caused by a grinding pressure to be transmitted to the lens 6 to be ground, can be made uniform from the central axis to the periphery of the lens 6. Accordingly, the deformation of the lens 6 during grinding can be lessened to a sufficient extent so that grinding accuracy can be further improved.

SIXTH EMBODIMENT

Figure 7:
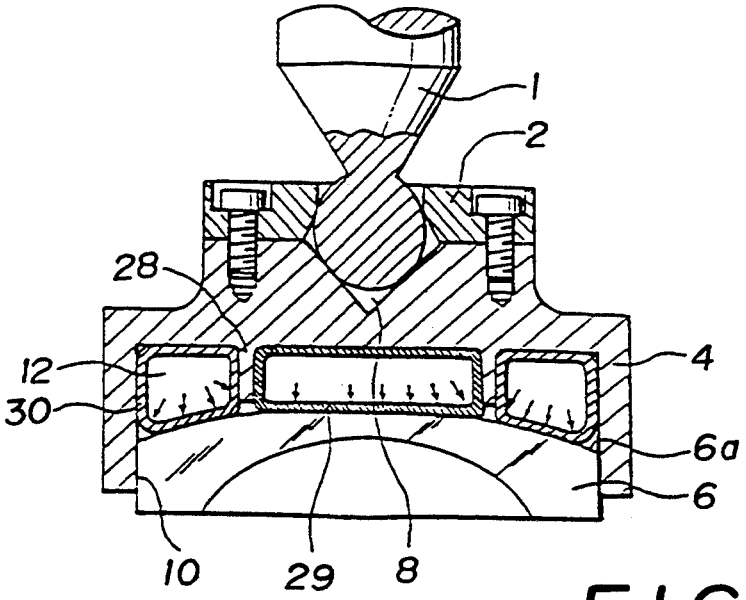
FIG. 7 is a diagrammatic side elevational view which shows in section a sixth embodiment of the holding device for holding an optical element to be ground in accordance with the present invention.

FIG. 7 is a side elevational view showing in section a holder base according to a sixth embodiment of the present invention.

In this figure, the same reference numerals are used to denote the same elements as those used in any of the embodiments described above, and the explanation of the corresponding elements is not given. As illustrated, a holder base 4 has a cone-shaped recess 8 formed in its upper portion, and the cone-shaped recess 8 is engaged with a spherical end portion 7 of a coupling member 1. A securing disc 2 is mounted on the upper end face of the holder base 4 so as to allow the end portion 7 to freely rotate and to prevent it from coming off the cone-shaped recess 8.

A disc-shaped opening 10, which has a configuration corresponding to that of a lens 6 to be ground, is formed in the lower end portion of the holder base 4. An annular rib 28 is formed at a predetermined position on the bottom of the disc-shaped opening 10 and extends to such an extent that it does not project from the lower edge of the holder base 4. A bag-like elastic member 29 which has a circular configuration in plan view is fitted into the inner periphery of the rib 28 in the disc-shaped opening 10, i.e., into the middle portion of the disc-shaped opening 10. Another bag-like elastic member 30 of a doughnut-like configuration is fitted into the annular space between the outer periphery of the rib 28 and the inner periphery which defines the disc-shaped opening 10.

Prior to mounting of the elastic members 29 and 30, each of them is charged with, for example a fluid pressurized in accordance with the configuration of the lens 6 to be ground and grinding conditions.

In the embodiment shown in FIG. 6, since the lens 6 to be ground is a meniscus lens of the kind which suffers the most serious deformation due to grinding pressure, the elastic members 29 and 30 are arranged such that the pressure gradually decreases from the center to the outer periphery of the lens 6. In other words, the fluid pressure of the elastic member 29 is kept strong compared to that of the elastic member 30.

As a matter of course, if the lens 6 to be ground is a different type of lens such as a lens with convex opposite surfaces, a lens with concave opposite surfaces, or the like, the aforesaid pressure difference is varied in accordance with the configuration of each type of lens.

In accordance with the sixth embodiment having the above-described arrangement and construction, by making the inner fluid pressures of the respective elastic members 29 and 30 different from each other, the displacements of the elastic members 29 and 30 along the Z axis, caused by a grinding pressure, can be made uniform from the central axis to the periphery of the lens 6. Accordingly, the deformation of the lens 6 during grinding can be lessened to a sufficient extent so that grinding accuracy can be further improved.

In the sixth embodiment, although a single rib 28 is formed for the purpose of illustration only, two or more ribs may of course be formed, as required, in accordance with the configuration of a lens to be ground and grinding conditions.

Although not stated in the description of the sixth embodiment, the fluid pressures to be supplied to the elastic members 29 and 30 can of course be freely adjusted.

Figure 8:
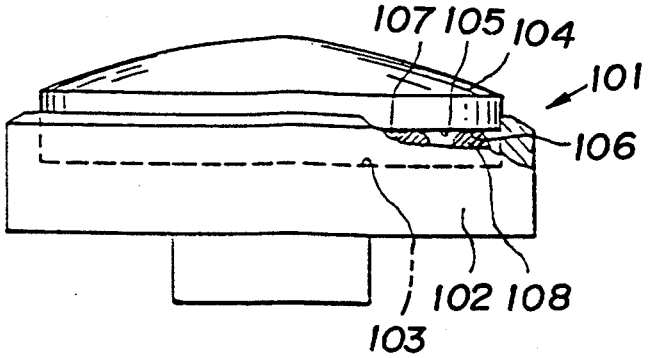
FIG. 8 is a diagrammatic side elevational view which shows in section a fifth embodiment of the holding device for holding an optical element to be ground in accordance with the present invention.

FIG. 8 is a partially broken away side elevational view which serves to illustrate seventh to tenth embodiments of a holding device of the present invention. A holding device 101 is arranged including a plurality of receiving members 108 having elasticity disposed between a receiving face 103 of a holder 102 and a receiving face 105 of a lens 104, and the receiving members 108 each have a supporting portion 106 for coming into abutment with the receiving face 105 of the lens 104 and spaces (gaps) 107 are defined between these supporting portions 106. Accordingly, the supporting portions 106 and the spaces 107 cooperate with each other to enable sufficient utilization of the elasticity of the receiving members 108.

SEVENTH EMBODIMENT

Figure 9:
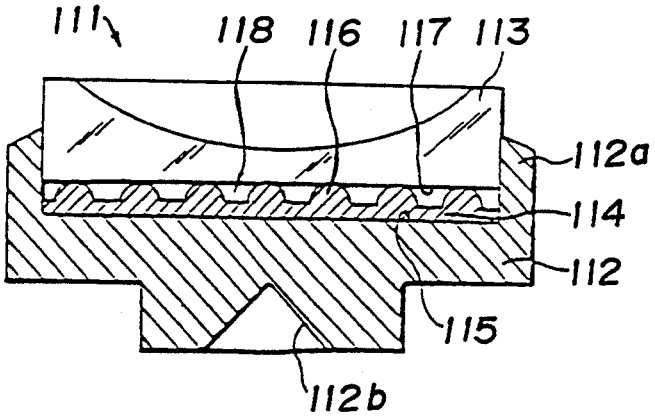
FIG. 9 is a schematic side elevational view showing in section the seventh embodiment of the present invention.

FIG. 9 is a cross-sectional view showing in section a grinding holder device according to the seventh embodiment of the present invention. As illustrated, a holding device 111, which is mounted on a grinding apparatus (not shown), comprises a holder 112 which is the body of the holding device 111 and a receiving member 114 made of silicone rubber, the receiving member 114 being disposed to be sandwiched between the holder 114 and a lens 113 to be ground when the lens 113 is held by the holding device. The inner wall surface of the outer periphery of the holder 112 is formed to be fitted onto the outer periphery of the lens 113. The holder 112 further has a recess 112*b* for receiving the coupling member of the grinding apparatus. Since the lens 113 is a flat concave lens, the receiving member 114 is bonded to the lens receiving face 115 of the holder 112, as by an adhesive. The receiving member 114 has a multiplicity of hemispherical projections 116 formed on one surface. These projections 116 are formed so as to uniformly abut against a lens-side receiving face 117 of the lens 113 to define air spaces 118 between the adjacent projections 116.

In the above-described arrangement, while the lens 113 held in position is being ground, the projections 116 of the receiving member 114 swell due to a grinding pressure and are deformed to make uniform the elasticity of the receiving member 114. Accordingly, since the lens 113 is not affected by the nonuniform elasticity of the receiving member 14, no deformation occurs in the lens 113.

Accordingly, even in the case of a thin lens, nonblocking grinding can be employed to achieve a high degree of surface precision free from distortion.

The receiving member 114 can be mass-produced at low cost from a molding material such as silicone rubber, urethane rubber or the like by means of forming dies. The projections 116 may be formed into cone-shaped configurations, columnar configurations or various other configurations which can provide spaces between the adjacent projections to achieve similar advantages and effects.

EIGHTH EMBODIMENT

Figure 10:
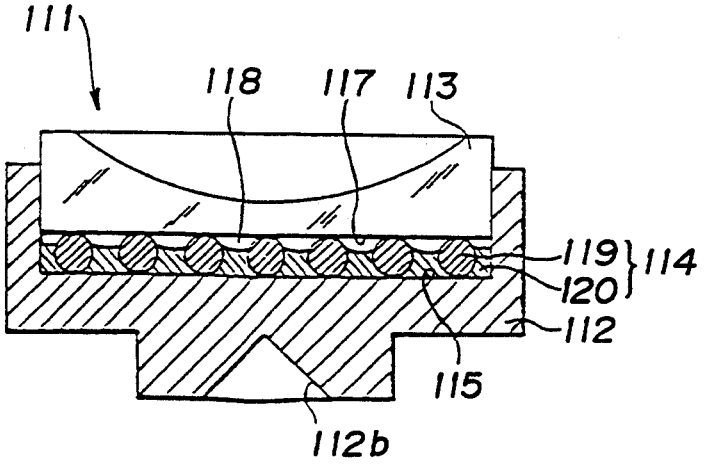
FIG. 10 is a schematic side elevational view showing in section the eighth embodiment of the present invention.

FIG. 10 is a cross-sectional view showing in section a grinding holder device according to the eighth embodiment of the present invention. The same reference numerals are used to denote the same elements as those used in the seventh embodiment, and the description thereof is omitted. As illustrated, a receiving member 114 consists of a multiplicity of balls 119 made of silicone rubber and a fixing agent 120 such as a silicone-type potting agent, a silicone-type adhesive or the like, the balls 119 being fixed to the lens-side receiving face 115 of the holder 112 by the fixing agent 120. The balls 19 define air spaces 118 between the lens-side receiving face 117 of the lens 113.

With this embodiment, it is likewise possible to achieve a high degree of surface precision free from distortion.

The balls 19 can be produced easily and inexpensively by using elastic balls of the kind which is commercially available. Moreover, the density of the balls 19, hence the elasticity of the receiving member 14, can be adjusted as required.

NINTH EMBODIMENT

Figure 11A:
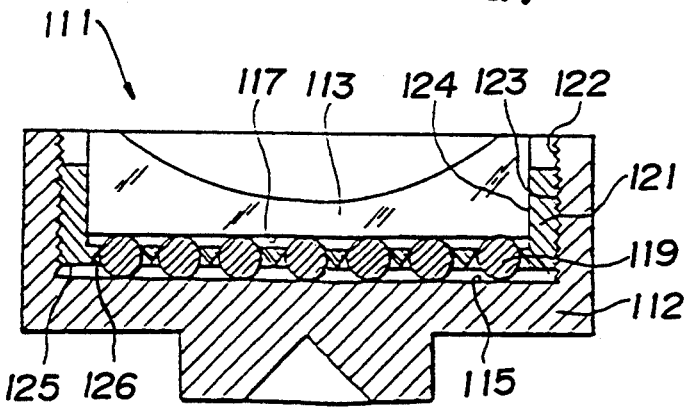
FIG. 11*a* is a schematic side elevational view showing in section the ninth embodiment of the present invention.
Figure 11B:
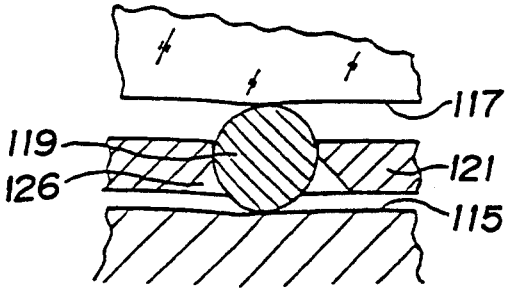
FIG. 11*b* is an enlarged view of the essential portion of FIG. 11*a;*

FIGS. 11*a* and 11*b* are a cross-sectional view and an essential enlarged view of a grinding holding device according to the ninth embodiment. The same reference numerals are used to denote the same elements as those used in the eighth embodiment and the description thereof is omitted. As illustrated, a retaining element 121 for holding balls 119 made of silicone rubber are provided on the holder-side receiving face 115 of a holder 112. The retaining element 121 has an externally threaded portion 123 formed around its outer periphery so that it can be screwed into an internally threaded portion 122 formed around the inner periphery of the holder 112. The retaining element 121 further has an inner periphery 124 formed to fit onto the outer periphery of the lens 113. A bottom portion 125 of the retaining element 121 has taper-shaped apertures 126 for securing receiving members at locations conforming to the layout of balls 119. The apertures 126 serve to bear the balls 119 for rotation with respect to the holder-side receiving face 115 and also so that the projections which abut against the lens-side receiving face 117 can be freely deformed.

With this embodiment as well, it is possible to achieve grinding with a high degree of surface precision free from distortion.

In this embodiment, the balls 19, if worn out, can be easily replaced.

TENTH EMBODIMENT

Figure 12A:
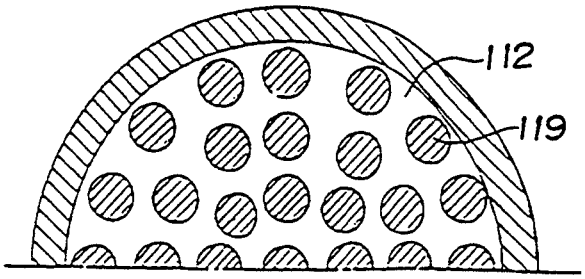
FIG. 12*a* is a cross-sectional plan view showing one half of the tenth embodiment of the present invention.
Figure 12B:
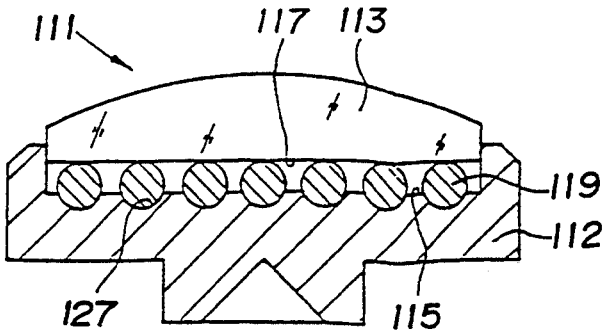
FIG. 12*b* is a side cross-sectional view of the tenth embodiment of the present invention.
Figure 13A:
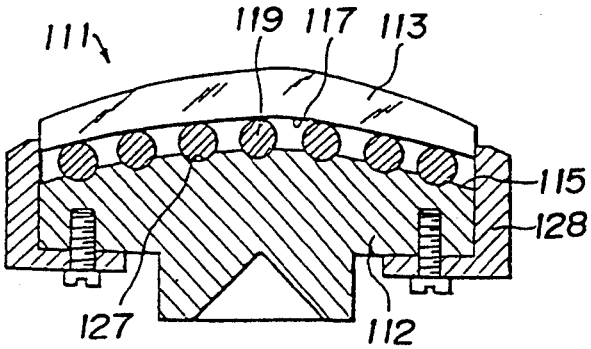
FIGS. 13*a*and 13*b* are are cross-sectional side views of modifications of the tenth embodiment.

FIGS. 12*a* and 12*b* show a grinding holding device according to the tenth embodiment. FIG. 12*a* is a cross-sectional plan view of one half of the holding device with FIG. 12*b* being a side cross-sectional view of the holding device. The same reference numerals are used to denote the same elements as those used in the eighth and ninth embodiments and the description thereof is omitted. As illustrated, a multiplicity of recesses 127, each having a hemispherical configuration corresponding to the diameter of a ball 119 made of elastomer such as silicone rubber, are formed in the portion of the holder 112 which is adjacent to its holder-side receiving face 115. Accordingly, by disposing the balls 119 in the respective recesses 127, the holding device can be easily produced by using the adhesive agent 120 (as in the eighth embodiment) or the fixing element 121 (as in the ninth embodiment), and advantages and effects similar to those of the aforesaid embodiments can be achieved. This tenth embodiment can be easily applied to any form of lens-side receiving face 117, whether a concave form (as shown in FIG. 13*a*) or a convex form. In either case, as shown in FIG. 13*a*, a holder 112 may be detachably mounted in a shell 128 so that the holder-side receiving face 115 of the holder 112 can be easily worked.

Figure 13B:
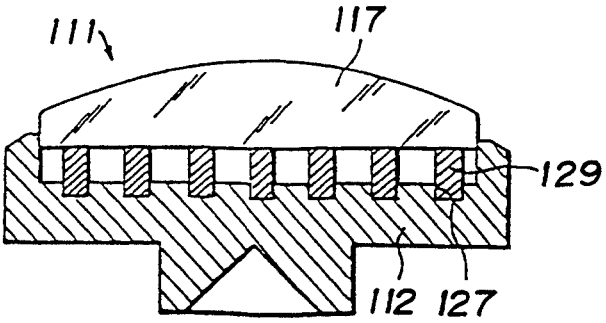

In order to fix the balls 119 in the recesses 127, they may be bonded to each other after the fixing agent 120 has been applied to the recesses 127 or after the fixing agent 120 has been applied to the surfaces of the respective balls 119. As shown in FIG. 13*b*, the recesses 127 may be formed into various configurations so that they can accommodate not only the balls 119 but also columnar elements 129, or prism-shaped elements, cone-shaped elements, pyramid-shaped elements or the like. With any of the configurations, it is possible to achieve similar advantages and effects. Although the tenth embodiment has been explained with reference to a lens, the embodiment can be applied to various optical elements such as prisms, filters or the like.

Figure 14:
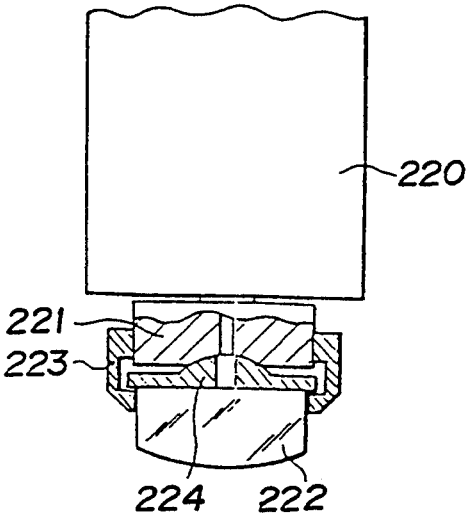
FIG. 14 is a schematic view which serves to illustrate the concept of a holding device for holding an optical element to be ground according to claim 14.
Figure 15:
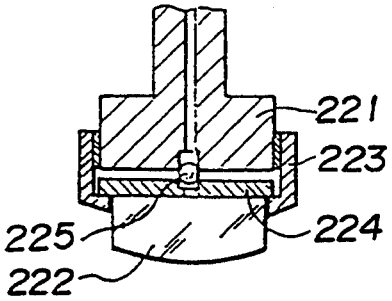
FIG. 15 is a schematic view which serves to illustrate the concept of a holding device for holding an optical element to be ground according to claim 15.

FIGS. 14 and 15 are schematic views which serve to illustrate eleventh to twelfth embodiments of a holding device according to the present invention. As illustrated; a lens receiving member 224 for holding a lens 222 by sucking force is arranged to come into contact with a holder body 221 via an element which can tilt with respect to the holder body 221 with their axes offset from each other. The outer periphery of the lens 222 is secured by a fixed ring 223 so that the movement of the lens 222 can be restricted. Accordingly, the holding device is capable of freely moving in the space between the holder body 221 and the lens receiving member 224 and the space between the fixed ring 223 and the lens 222.

ELEVENTH EMBODIMENT

Figure 16A:
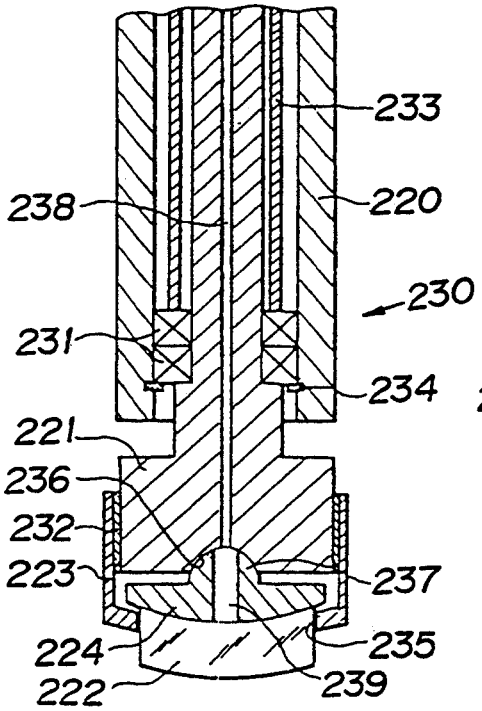
FIG. 16*a* is a front elevational view showing in section an eleventh embodiment of the holding device for holding an optical element to be ground in accordance with the present invention.

FIG. 16*a* is a cross-sectional view showing a grinding work holder 230 according to the eleventh embodiment of the present invention.

As illustrated, the grinding work holder 230 comprises a housing 220, a holder body 221 rotatably supported on the housing 220 by a bearing 231, a fixed ring 223 screwed onto a threaded portion 232 formed around the outer periphery of the holder body 221, a lens receiving member 224 for supporting the reverse face of a lens 222 to be ground (the face of the lens 222 which is opposite to its face to be ground) and for absorbing the inclination of the lens 222, and the like. Reference numeral 233 denotes a collar and reference numeral 234 denotes a C ring.

The fixed ring 223 has an aperture 235 at one end in the axial direction (the lower end as viewed in FIG. 16*a*), and the aperture 235 is formed so that its inner periphery is fitted into the outer periphery of the lens 222. The aperture 235 is positioned coaxially to the axis of the fixed ring 223, namely, the axis of the holder body 221. The precision of engagement between the aperture 235 and the lens 222 is selected to be as small as 0.1 mm or less. The radial offset of the lens 222 is restricted within such an extremely limited minimum required range.

A hemispherical recess 236 is formed in the lower end portion of the holder body 221 at a location centered about its axis, while a hemispherical projection 237 projects from the face of the lens receiving member 224 which faces the holder body 221. The hemispherical projection 237 is formed to be fitted into the hemispherical recess 236. Even if the lens 222 is inclined within the aforesaid limited range due to grinding resistances during grinding or slightly displaced during rotation, such a displacement can be absorbed by the relative sliding of the hemispherical recess 236 and the hemispherical projection 237.

Communication bores 238 and 239 extend through the holder body 221 and the lens receiving member 224 along their axes, respectively. The communication bores 238 and 239 are in alignment with each other and the communication bore 238 communicates with air equipment (not shown) so that the lens 222 supported on the lens receiving member 224 can be retained by sucking forces.

When the lens 222 is to be ground by means of the grinding work holder 230 having the above construction, the lens 222 is inserted into the aperture 235 of the fixed ring 223 and the lens 222 is retained on the lens receiving member 224 by the sucking force introduced through the communication bores 238 and 239. The lens 222 which is retained by the sucking force is forced against a grinding stone (not shown) for grinding purposes.

In particular, with the eleventh embodiment having the arrangement and construction described above, the radial offset of the lens 222 is restricted to the minimum required amount by means of the aperture 235 of the fixed ring 223. Also, even if the lens 222 which is retained on the lens receiving member 224 by sucking force is inclined within the aforesaid limited range due to grinding resistances during grinding or slightly displaced or vibrated during rotation, such a displacement or vibration can be effectively absorbed by the relative sliding of the hemispherical recess 236 and the hemispherical projection 237. Accordingly, the lens 222 is reliably prevented from vibrating vehemently so that a high-quality lens having an excellent surface precision can be produced.

Figure 16B:
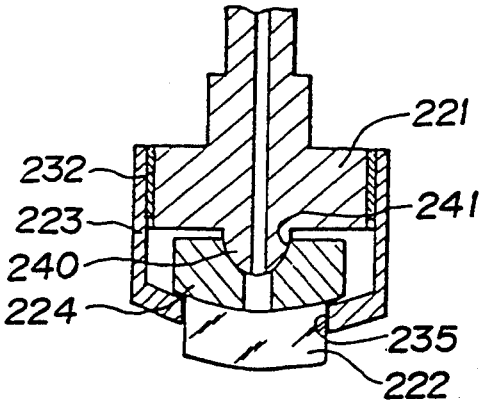
FIG. 16*b* is a front elevational view showing in section a modification of the eleventh embodiment of FIG. 16*a;*

The configurations of the hemispherical projection 237 and the hemispherical recess 236 are not limited to the ones shown in FIG. 16*a*. As shown in FIG. 16*b*, a hemispherical projection 240 may be formed on the holder body 221 with a hemispherical recess 241 formed in the lens receiving member 224. With such an arrangement, similar advantages and effects can be obtained.

TWELFTH EMBODIMENT

Figure 17A:
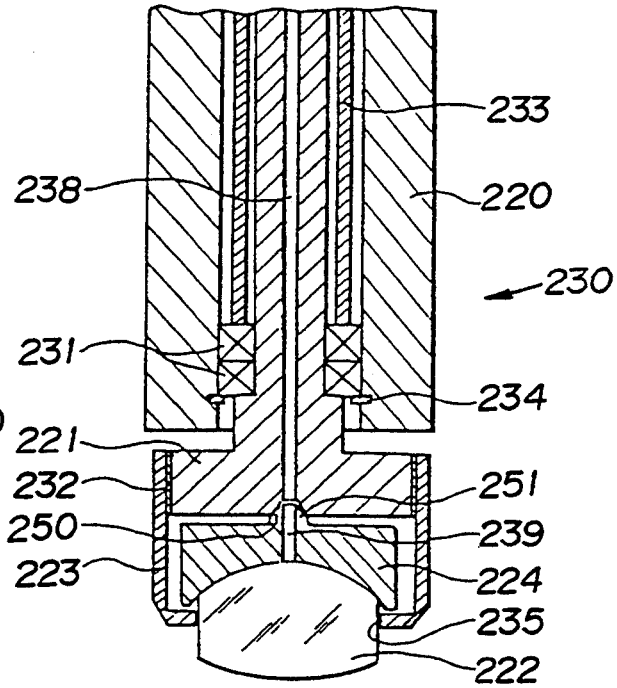
FIG. 17*a* is a front elevational view showing in section a twelfth embodiment of the holding device for holding an optical element to be ground in accordance with the present invention.

FIG. 17*a* is a cross-sectional front elevational view showing a grinding work holder 230 according to the twelfth embodiment of the present invention. The primary feature of the twelfth embodiment is that a cone-shaped recess 250 and a hemispherical projection 251 are formed in place of the hemispherical recess 236 and the hemispherical recess 237 used in the eleventh embodiment shown in FIG. 16*a*. Since the remaining elements are similar to those of the eleventh embodiment, the same reference numerals are used to denote the same elements and the description thereof is omitted.

Although the above-described arrangement and construction can achieve advantages and effects similar to those of the eleventh embodiment, further advantages, which will be described later, can be achieved with the grinding holder 230 according to the twelfth embodiment. First, since the cone-shaped recess 250 and the hemispherical projection 251 are disposed to come into line contact with each other, the sliding characteristics of them are extremely improved so that the performance of the holder 230 to follow closely the inclination of the lens 222 which may take place within the aperture 235 can be greatly improved. In consequence, the inclination of the lens 222 (within the extremely limited range) can be absorbed extremely effectively. Second, although working of a spherical surface generally involves difficult processes and high cost, in this embodiment it suffices to apply spherical-surface working to one face only unlike the eleventh embodiment. Accordingly, it is possible to reduce the manufacturing cost compared to the eleventh embodiment.

The other operations and advantages are similar to those of the eleventh embodiment and the description thereof is omitted.

Figure 17B:
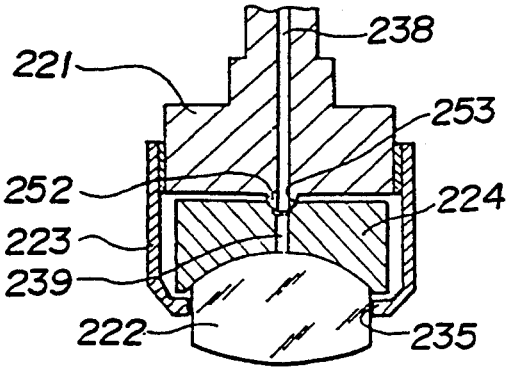
FIG. 17*b* is a front elevational view showing in section a modification of the twelfth embodiment of FIG. 17*a;*

In the twelfth embodiment as well, as shown in FIG. 17*b*, a hemispherical projection 252 may be formed on the holder body 221 with a cone-shaped recess 253 formed in the lens receiving member 224 in a manner similar that used in the eleventh embodiment. With such a construction, it is possible to achieve advantages and effects similar to those described above.

THIRTEENTH EMBODIMENT

Figure 18:
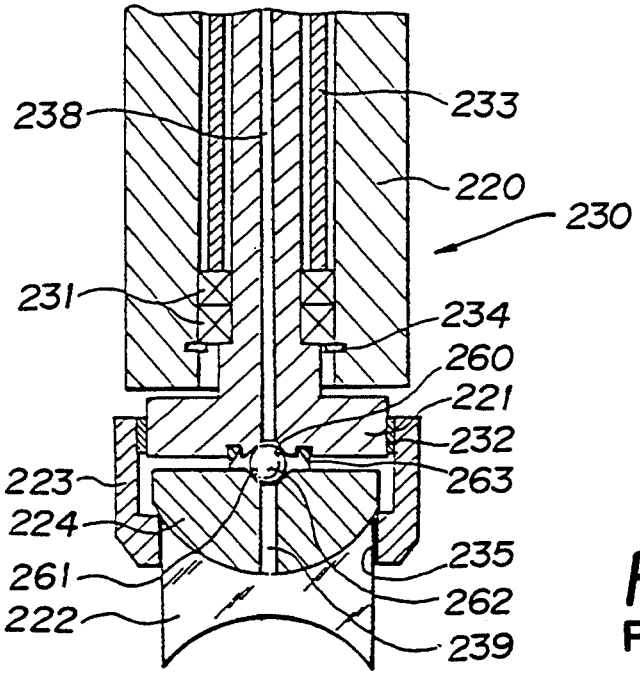
FIG. 18 is a front elevational view showing in section a thirteen embodiment of the holding device for holding an optical element to-be ground in accordance with the present invention.
Figure 19:
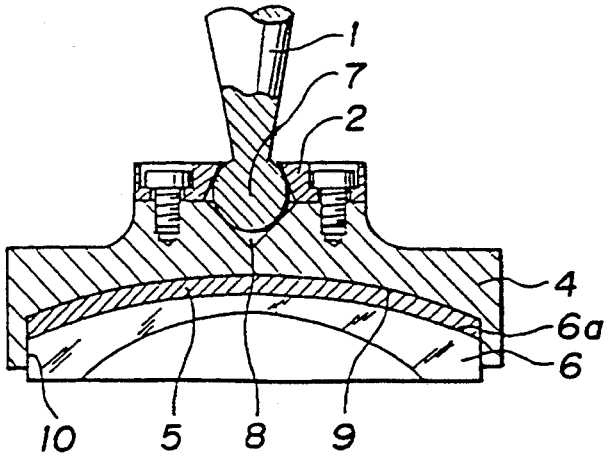
FIG.19 PRIOR ART
FIGS. 19–22 are views which serve to illustrate related arts.
Figure 20:
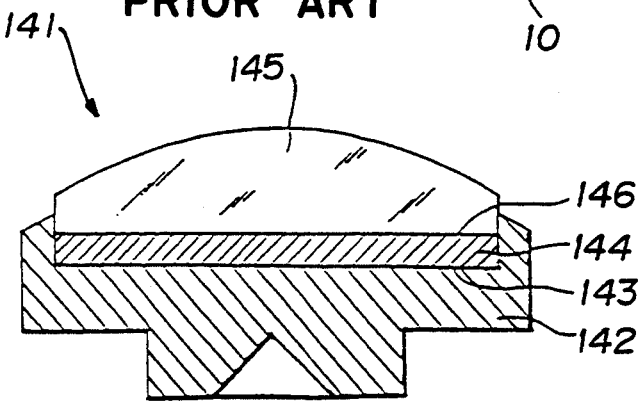
FIG.20 PRIOR ART
Figure 21:
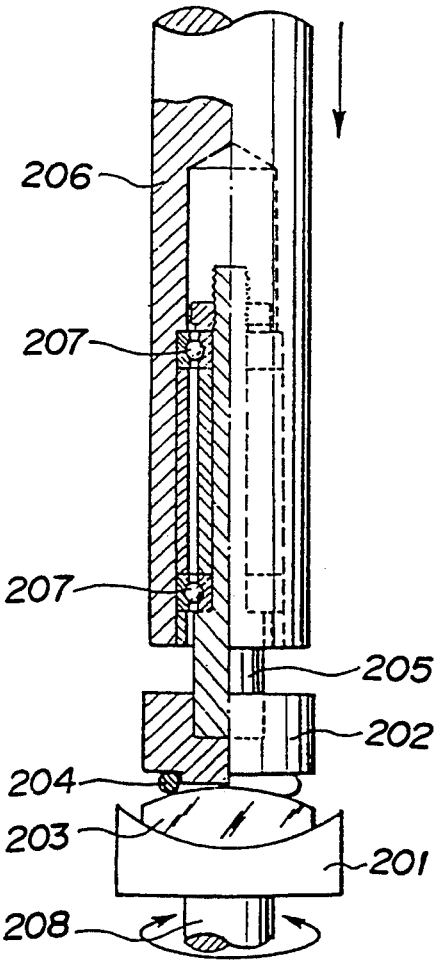
FIG. 21 PRIOR ART
Figure 22:
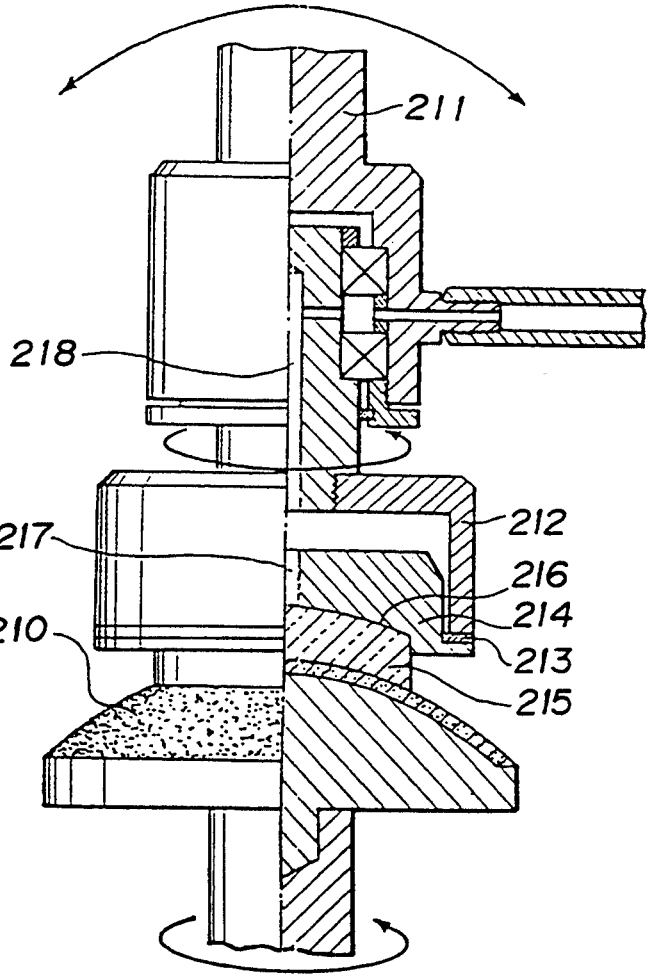
FIG. 22 PRIOR ART

FIG. 18 is a cross-sectional front elevational view showing a grinding work holder according to the thirteenth embodiment of the present invention. In this embodiment, cone-shaped recesses 260 and 261 are formed in the opposing end portions of a holder 221 and a lens receiving member 224, respectively, and a tilt assisting member 262 made from a steel ball is fitted between the recesses 260 and 261. The tilt assisting member 262 and the lens receiving member 224 are held in position by means of a fixed ring 223 screwed onto an externally threaded portion 232 of the holder body 221. Reference numeral 263 denotes a ring having a V-like configuration in cross section, the ring 263 serving to prevent leakage of sucking air which acts to attract the lens 22. Since the other elements are similar to those used in the eleventh embodiment, the same reference numerals are used to denote the same elements as those used in the eleventh embodiment and the description thereof is omitted.

The precision of engagement between the lens 222 and the aperture 235 of the fixed ring 223 is selected to be as small as 0.1 mm or less. The radial offset of the lens 222 is restricted within such an extremely limited minimum required range. The inclination of the lens 222 can be effectively absorbed by the relative sliding of the tilt assisting member 262 and the cone-shaped recesses 260 and 261, and the behavior of the lens 222 is restricted within the range of 0.1 mm or less by the restricting action of the fixed ring 223. Accordingly, the thirteenth embodiment having the above-described arrangement and construction can achieve advantages and effects similar to those of the eleventh embodiment. However, further advantages, which will be described later, can be achieved by the thirteenth embodiment. First, since the recesses 260 and 261 in contact with the steel-spherical tilt assisting member 62 are each formed into a cone-shaped configuration, the tilt assisting member 262 comes into line contact with the recesses 260 and 261 so that the sliding characteristics of them are extremely improved. Second, with the thirteenth embodiment, spherical-surface working of the type which generally incurs high cost is not at all needed. Accordingly, it is possible to reduce the manufacturing cost to a further extent.

In each of the above embodiments, a lens having a configuration of one particular kind only is illustrated. However, by forming the lens receiving face of the lens receiving member 224 into an appropriate configuration, any of the embodiments can of course be applied to lenses of various configurations.

In accordance with the present invention which provides the above-described arrangements and constructions, it is possible to suppress the deformation of optical elements or objects to be worked which are susceptible to deformation due to a pressure or the deformation of optical elements due to a high working pressure. It is also possible to work such an optical element or object without impairing the external appearance and quality of its retained face.

In accordance with the present invention, during grinding, the supporting portions of receiving members which abut against the receiving face of an optical element at a plurality of locations can be deformed in a swollen form within the spaces defined between the adjacent supporting portions. Accordingly, it is possible to produce a thin optical element having a high surface precision by nonblocking grinding without impairing the external appearance and quality of the receiving face of the optical element.

In addition, with a grinding work holder according to the present invention, the radial offset of a lens to be ground can be restricted within a minimum required range, and the inclination of the lens, namely, the displacement of the lens due to grinding resistances or slight vibrational displacement of the lens during rotation thereof can be effectively absorbed within the above limited range. Accordingly, the lens is reliably prevented from vibrating vehemently during grinding so that a high-quality lens having an excellent surface precision can be produced.

In addition to the above advantages, it is possible to achieve an improvement in follow-up characteristics and a reduction in cost.

What is claimed is:

1. A holding device for holding an optical element having two opposed majors surface separated by a peripheral edge surface during a grinding process, comprising:

a holding member rotatably and tiltably supported on a shaft and having a recessed receiving surface configured and dimensioned to releasably engage with an outer peripheral edge surface of the optical element; and a pressure distributing member having an undivided surface in contact with one major surface of the optical element for contacting and supporting the entire one major surface of the optical element, the pressure distributing member being deformable in varying amounts at portions thereof which are subjected to varying amounts of grinding pressure produced during grinding of the other major surface of the optical element, the contact with said entire one major surface and the varying amounts of deformation of the pressure distributing member being effective to uniformly distribute the grinding pressure along the one major surface of the optical element.

2. A holding device for holding an optical element to be ground according to claim 1; wherein the pressure distributing member comprises an elastic member having uniform deformability characteristics.

3. A holding device for holding an optical element having two opposed major surfaces separated by a peripheral edge surface during a grinding process, comprising:

a holder base having a concave portion for holding the optical element in an engaged state, the concave portion having a shape corresponding to an outer peripheral edge surface of the optical element and engageable with the peripheral edge surface thereof to define the movement of the optical element in the radial direction; and an elastic member disposed in the concave portion between the holder base and the optical element, the elastic member being in continual contact with both the holder base and the optical element during a feeding operation and a grinding operation of the optical element, the elastic member being composed of material deformable in varying amounts so that the elastic member is relatively slightly deformable at a portion thereof in which a grinding pressure during grinding of the optical element is large and being relatively greatly deformable at a portion thereof in which the grinding pressure is small, the deformable amount of the elastic member being gradually varied in the radial direction of the optical element about an optical axis of the optical element, wherein the deformable amount of the elastic member varies depending on predetermined grinding characteristics.

4. A holding device for holding an optical element to be ground according to claim 2; wherein the deformable amount is adjusted by a varying thickness of the elastic member.

5. A holding device for holding an optical element to be ground according to claim 2; wherein the deformable amount is adjusted by a varying rigidity of the elastic member.

6. A holding device for holding an optical element having two opposed major surfaces separated by a peripheral edge surface during a grinding surface, comprising: a holding member rotatably and tiltably supported on a shaft and having a recessed receiving surface configured and dimensioned to directly engage with a peripheral edge surface of an optical element to be ground to prevent radial displacement thereof; and an elastic member disposable between the receiving surface and one major surface of the optical element so as to be in continual contact with both the holding member and said one major surface of the optical element during a feeding operation and a grinding operation of the optical element, the elastic member being effective to uniformly distribute a grinding pressure along the other major surface thereof during the grinding operation of the optical element by deforming in varying amounts at portions of the elastic member subjected to the grinding pressure.

7. A holding device according to claim 6; wherein the elastic member has non-uniform deformability characteristics which are dependent on predetermined grinding characteristics.

8. A holding device according to claim 7; wherein the non-uniform deformability characteristics are dependent on a varying thickness of the elastic member.

9. A holding device for holding an optical element to be ground during a grinding process, comprising:

a holder base rotatably and tiltably supported on a symmetrical axis and having a recessed receiving surface configured and dimensioned to releasably engage with an outer peripheral edge surface of the optical element; and an elastic member disposed between the holder base and a rear surface of the optical element opposite to a surface of the optical element to be ground, the elastic member being deformable in an amount varying continuously from the symmetrical axis in the radial direction of the optical element.

10. A holding device for holding an optical element according to claim 9; wherein the elastic member has a thickness varying in the radial direction of the optical element.

* * * * *